US007992305B1

(12) United States Patent
Herrick

(10) Patent No.: US 7,992,305 B1
(45) Date of Patent: Aug. 9, 2011

(54) TRI-CUT CABLE LINE CUTTER

(76) Inventor: Richard P. Herrick, Miramar, FL (US)

( * ) Notice: Subject to any disclaimer, the term of this patent is extended or adjusted under 35 U.S.C. 154(b) by 431 days.

(21) Appl. No.: 12/012,844

(22) Filed: Feb. 6, 2008

Related U.S. Application Data

(60) Provisional application No. 60/959,779, filed on Jul. 18, 2007.

(51) Int. Cl.
*B26B 27/00* (2006.01)

(52) U.S. Cl. ..... 30/95; 30/109; 83/628

(58) Field of Classification Search ..... 30/92–95, 30/109, 111, 113, 182, 183, 241, 165; 81/9.4, 81/9.43, 349, 361; 83/628, 437.1, 437.6, 83/597, 602
See application file for complete search history.

(56) References Cited

U.S. PATENT DOCUMENTS 2,162,141 A * 6/1939 Vest ..... 12/92
2,454,528 A * 11/1948 Temple ..... 30/228
2,462,701 A * 2/1949 Wirth ..... 30/123.3
3,372,477 A * 3/1968 Hoppe ..... 606/138
5,683,408 A * 11/1997 De Laage De Meux et al. ..... 606/184

* cited by examiner

*Primary Examiner* — Phong H Nguyen
(74) *Attorney, Agent, or Firm* — Ottman, Flynn & Kubler

(57) ABSTRACT

A cutter includes a guide tube having a tube proximal end and a tube distal end with a tube distal edge, a segment of the tube distal edge being beveled to form a tube cutting edge and an opposing segment of which defining a tube distal edge proximal recess relative to the tube cutting edge; a line engaging structure slidable within the guide tube for engaging a segment of line; and a displacement mechanism for displacing the line engaging structure relative to the tube cutting edge together with a segment of line retained by the line engaging structure into sheering contact with the tube cutting edge, the tube distal end proximal recess permitting a segment of line retained within the line engaging structure to move proximally past the tube cutting edge so that the line abuts the tube distal edge only at the tube cutting edge during line cutting.

2 Claims, 6 Drawing Sheets

TRI-CUT CABLE LINE CUTTER

FILING HISTORY

This application continues from provisional application Ser. No. 60/959,779 filed on Jul. 18, 2007.

BACKGROUND OF THE INVENTION

1. Field of the Invention

The present invention relates generally to the field of line cutting equipment. More specifically the present invention relates to a cut line cutter for cutting an elongate member or line such as KEVLAR™ line, steel braid, steel monofilament and virtually all other types of line, cleanly, and over a long reach without loss of mechanical advantage. The cutter includes a guide structure preferably in the form of a guide tube having a tube longitudinal axis and having a tube proximal end and a tube distal end with a tube distal edge, a segment of the tube distal edge being beveled to define a guide structure cutting edge in the form of a tube cutting edge along the guide tube inner diameter and an opposing segment defining a tube distal end proximal recess which is proximally recessed relative to the tube cutting edge. The line cutter further includes a line engaging structure slidable within the guide tube for engaging a segment of line, and includes a displacement mechanism for displacing the line engaging structure relative to the tube cutting edge together with a segment of line retained within the line engaging structure into sheering contact with the tube cutting edge. The tube distal end proximal recess permits a segment of line retained within the line engaging structure to move proximally past the tube cutting edge so that the line abuts the tube distal end only at the tube cutting edge during line cutting.

The line engaging structure preferably is a slide shaft having a shaft longitudinal axis and having a lateral line engaging passageway for receiving a segment of line generally perpendicular to the slide shaft longitudinal axis, the slide shaft being retained within the guide tube to be slidable along the slide shaft and guide tube longitudinal axes, so that the line engaging passageway and a segment of line within the line engaging passageway are slidable past and immediately adjacent to the tube cutting edge with a clearance of at most 0.015 inches to produce a sheering action with a clean cut and minimal wear to the tube cutting edge. Although 0.015 is the preferred maximum clearance, the preferred or optimum clearance or tolerance between the line engaging passageway and tube cutting edge is 0.010 inches. The line engaging passageway preferably is a line engaging notch which is cut into the side of the slide shaft and is angled distally, although a second version of the passageway is a bore following either a diametric path or the path of a geometric cord through the slide shaft. The guide tube and slide shaft can be made virtually as long as may be needed for great reach for specific uses without notable loss of mechanical advantage from displacement mechanism.

2. Description of the Prior Art

There have long been cutting tools or cutters of various types and for specific uses. Conventional wire cutters are often used to cut KEVLAR™ line, for example, but this rapidly wears out the wire cutters. Other tools are used to cut lines of other materials, such as steel braid. A problem with existing cutters has been that no single cutter is suited to cutting all or most types of lines or filaments, so that a variety of tools must be purchased, stored and carried in tool boxes. Another problem is that the useful life of even the best suited tool, as noted, can be made short when cutting lines of certain compositions. Still another problem is that braided line can be mashed and frayed during cutting with conventional tools. Yet another problem is that lines located deep within a structure, system or machine either cannot be reached and cut at all without time consuming disassembly, or are difficult and awkward to reach.

It is thus an object of the present invention to provide a line cutter which cuts lines formed of a wide variety of hard and durable materials and compositions, including KEVLAR™, stainless steel braid and stainless steel monofilament, the three types of line which most prior cutting tools cannot cut, and which cuts such lines cleanly and without fraying.

It is another object of the present invention to provide such a line cutter which easily slides over and along a line to the point to be cut, and so that cutter positioning can be done effortlessly and without looking closely.

It is still another object of the present invention to provide such a line cutter which provides an exceptionally large mechanical advantage so that the hardest and most durable lines can be cut with minimal force and effort.

It is a further object of the present invention to provide such a line cutter which easily strips insulation from a conductive core.

It is a still further object of the present invention to provide such a line cutter which is compact, and shorter versions of which can be carried in most tool boxes, or in a holster.

It is finally an object of the present invention to provide such a line cutter which is durable, reliable and relatively inexpensive to manufacture.

SUMMARY OF THE INVENTION

The present invention accomplishes the above-stated objectives, as well as others, as may be determined by a fair reading and interpretation of the entire specification.

A line cutter for cutting segments of line includes a guide structure having a guide structure distal edge, at least a segment of the guide structure distal edge being beveled to form a tube cutting edge; a line engaging structure slidable relative to the guide tube for engaging a segment of line; and a displacement mechanism for displacing the line engaging structure relative to the guide structure cutting edge together with a segment of line retained by the line engaging structure into sheering contact with the guide structure cutting edge.

A line cutter for cutting segments of line is further provided, including a guide structure in the form of a guide tube having a tube longitudinal axis and having a tube proximal end and a tube distal end with a tube distal edge, a segment of the tube distal edge being beveled to form a tube cutting edge and an opposing segment of which defining a tube distal edge proximal recess relative to the tube cutting edge; a line engaging structure slidable within the guide tube for engaging a segment of line; and a displacement mechanism for displacing the line engaging structure relative to the tube cutting edge together with a segment of line retained by the line engaging structure into sheering contact with the tube cutting edge, the tube distal end proximal recess permitting a segment of line retained within the line engaging structure to move proximally past the tube cutting edge so that the line abuts the tube distal edge only at the tube cutting edge during line cutting.

The line engaging structure preferably includes a slide shaft having a shaft longitudinal axis and having a lateral line engaging passageway for receiving a segment of line generally perpendicular to the slide shaft longitudinal axis, the slide shaft being retained within the guide tube to be slidable within the guide tube along the slide shaft longitudinal axis, so that the line engaging passageway and a segment of line retained within the line engaging passageway are slidable past and adjacent to the tube cutting edge, a clearance between them of at most 0.015 inches. The line engaging passageway preferably includes a line engaging notch extending into a side of the slide shaft and angled distally, and wherein the remainder of the tube distal edge is angled to correspond to the angle of the line engaging notch. The slide shaft has a shaft proximal end and a shaft distal end, and the line engaging passageway preferably is located at the shaft distal end. The tube cutting edge includes a segment of the tube distal edge substantially perpendicular to the tube longitudinal axis, and the tube distal edge preferably forms a distally protruding step adjacent to and at one end of the tube cutting edge for better retaining and positioning a segment of line within the line engaging passageway.

The guide tube and the slide shaft distal ends preferably are formed of heat treated tool steel. The non-anodized areas of the cutter, and particularly the cutting edge and line engaging passageway, preferably are coated with BRY-PLEX™ manufactured by BRY-COAT CORPORATION to prevent corrosion.

The shaft distal end which defines the line retaining structure preferably is a separable distal shaft segment removably mounted to the remainder of the slide shaft defining a proximal shaft segment. The distal shaft segment preferably includes a threaded axial mounting bore in the distal shaft segment proximal end, and the proximal shaft segment preferably includes a threaded axial mounting stud sized and configured to screw into the mounting bore. The distal shaft segment preferably includes an axial mounting bore in the distal shaft segment proximal end, and an axial mounting stud sized to fit into the mounting bore, the distal shaft segment and the proximal shaft segment having pin passageways which register when the mounting stud is fitted into the mounting bore, additionally including a wrist pin sized to fit snugly through the registering pin passageways.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
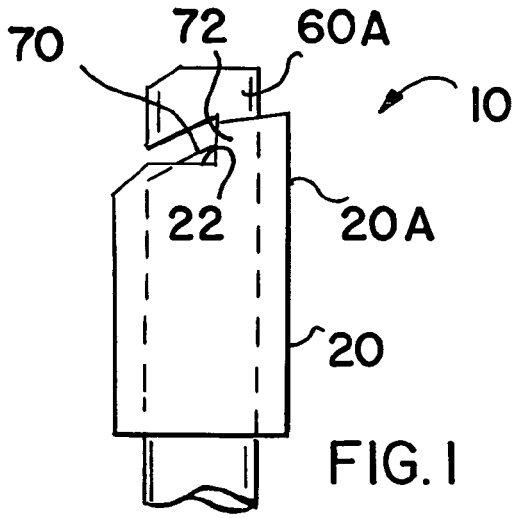
FIG. 1 is a side view of the distal end of the cutter preferred embodiment with the line engaging passageway or notch most exposed at the tube distal end.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 2:
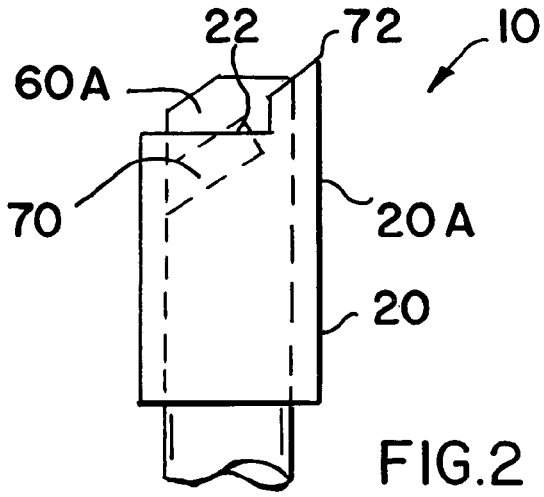
FIG. 2 is a side view of the cutter as in FIG. 1 with the line engaging notch withdrawn mostly into the tube distal end to the position where cutting of a segment of line in the notch would begin.
Figure 3:
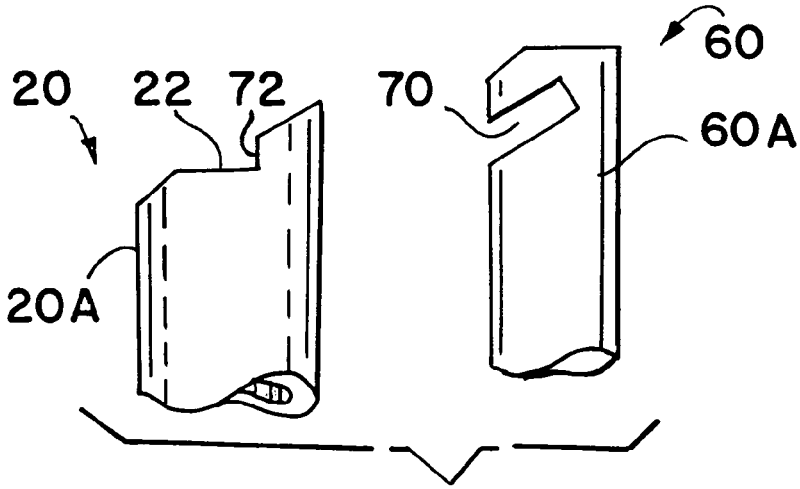
FIG. 3 is a side view of the guide tube and slide shaft distal ends of FIGS. 1 and 2 separated from and juxtaposed with each other.
Figure 10:
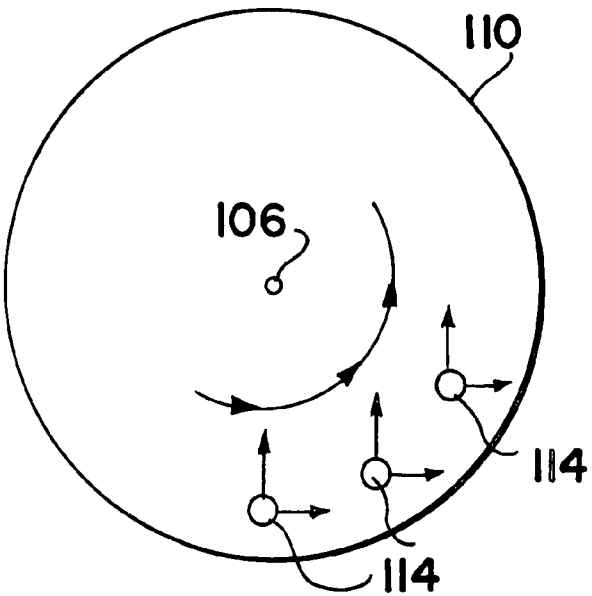
FIG. 10 is a side view of the shear showing the lever separation spring interconnecting the channel member of the tube rotation lever and the shaft rotation lever.
Figure 4:
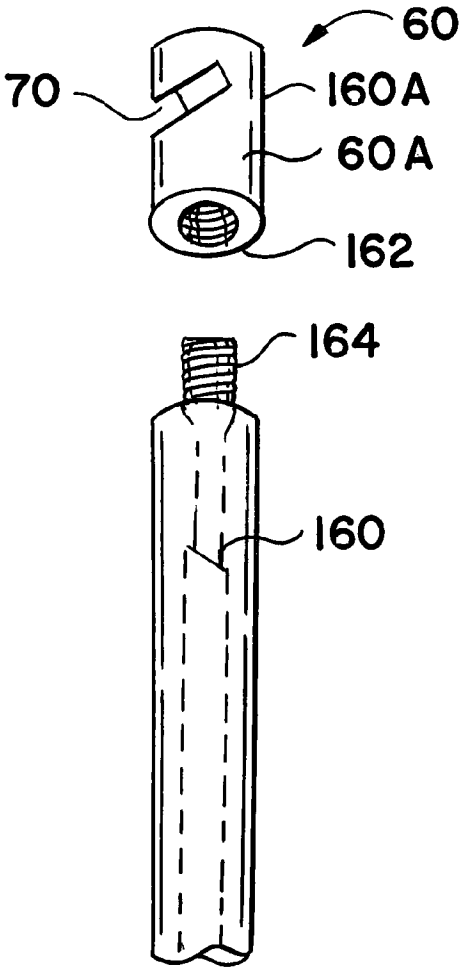
FIG. 4 is a perspective side view of the slide shaft distal end, where the distal shaft segment is separate from and attachable to the proximal shaft segment with a threaded mounting stud screwing into a threaded axial mounting bore.
Figure 6:
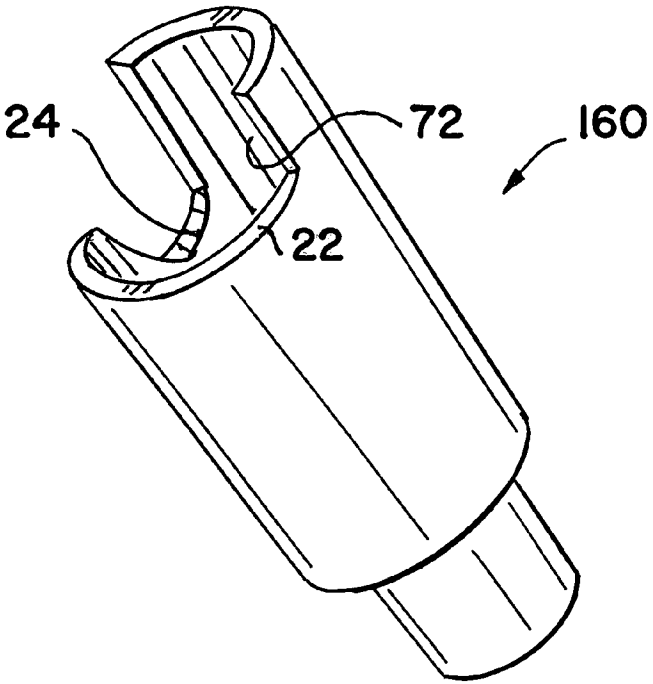
FIG. 6 is a broken away, close-up view of the cutter distal end, showing details of the tube distal edge and cutting edge segment of the distal edge, and showing a segment of line retained within the line engaging notch.
Figure 5:
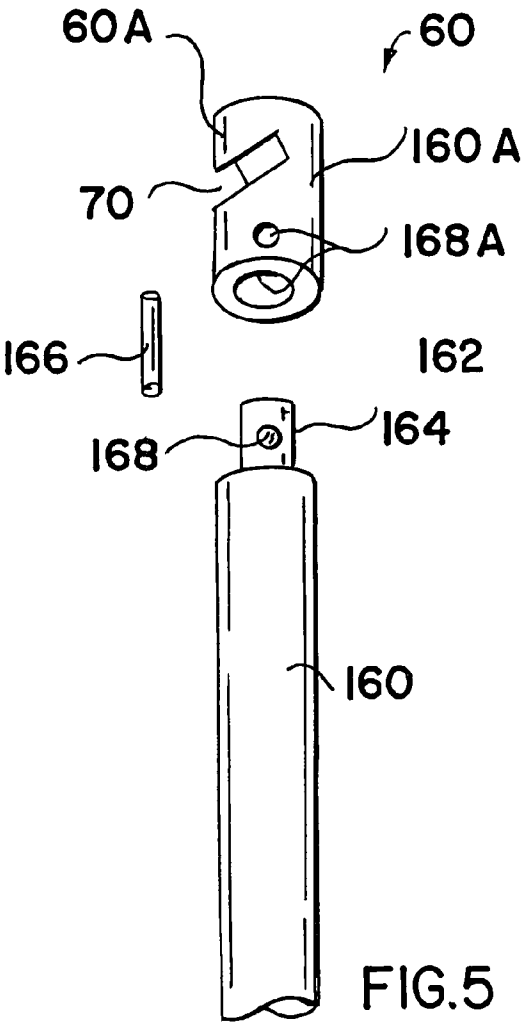
FIG. 5 is a perspective side view as in FIG. 4, except that the threads are omitted from the mounting stud and the axial mounting bore and replaced by an alternative a wrist pin and registering pin passageways.
Figure 7:
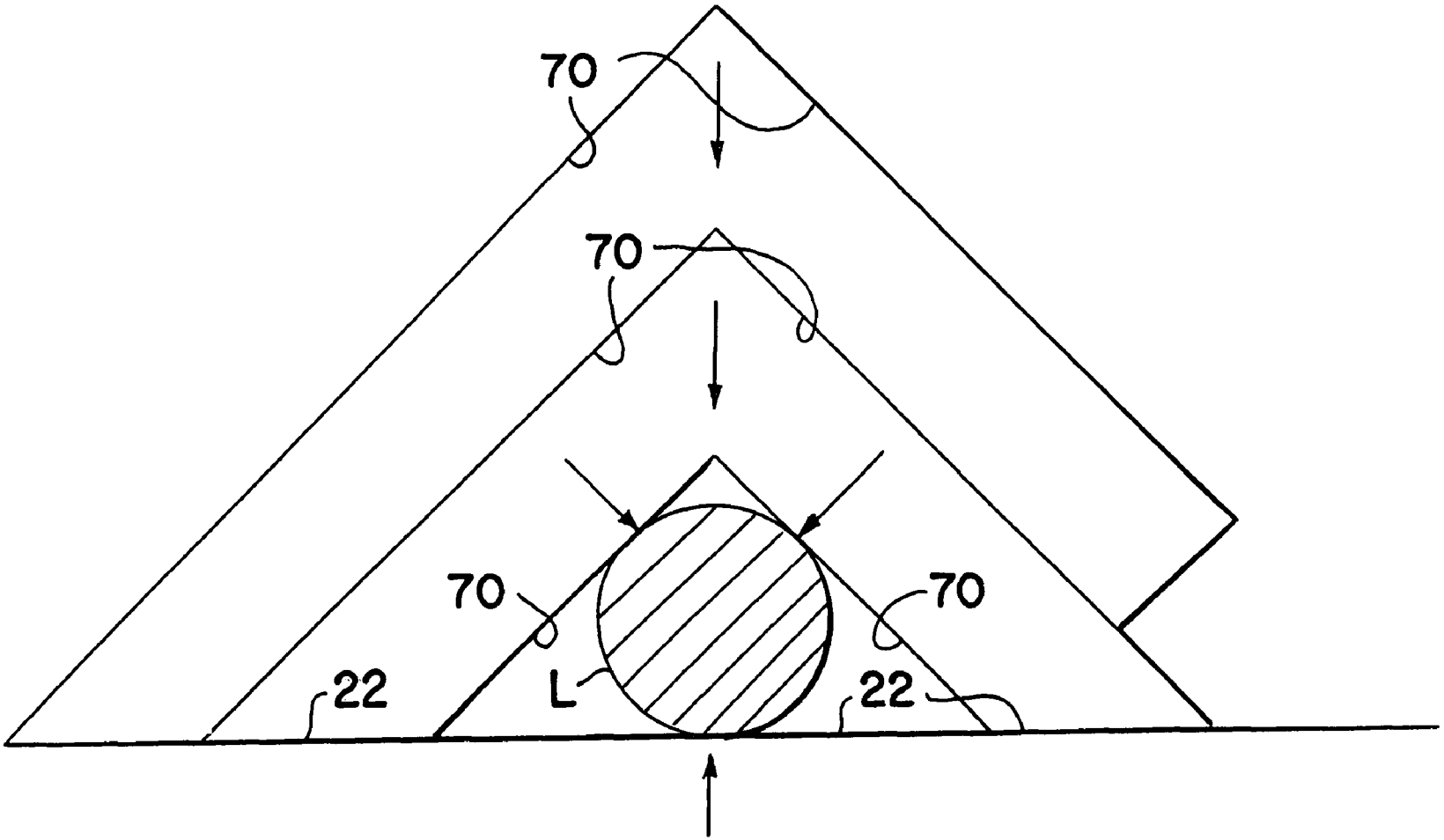
FIG. 7 is a progressive representation of the line engaging notch advancing proximally and compressing a line segment, shown in cross-section, against the cutting edge, illustrating how the present cutter compresses a line segment from three directions to prevent fraying of braided line during cutting.
Figure 8:
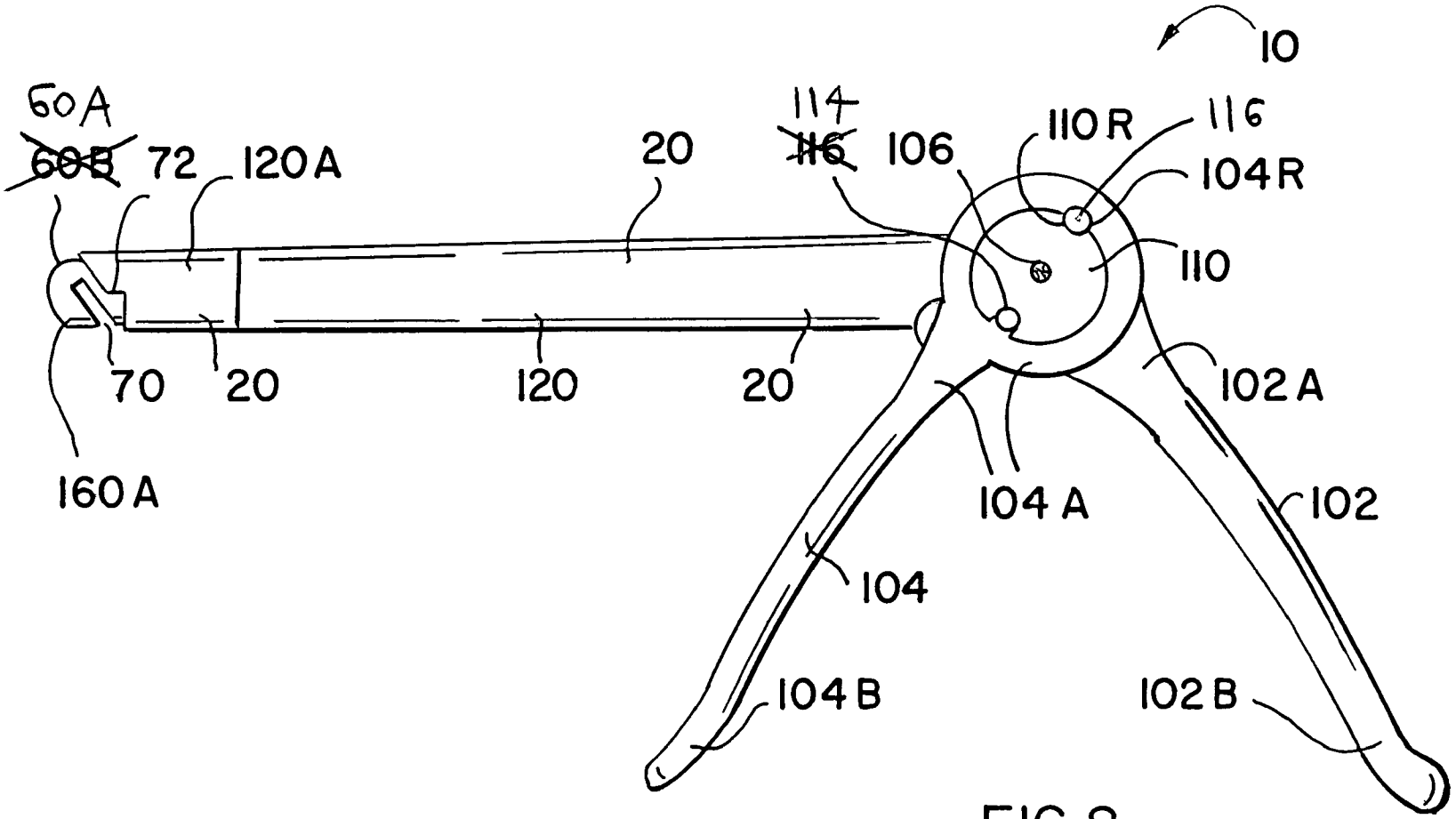
FIG. 8 is a full side view of the line cutter, showing the proximal end and the preferred displacement mechanism.
Figure 9:
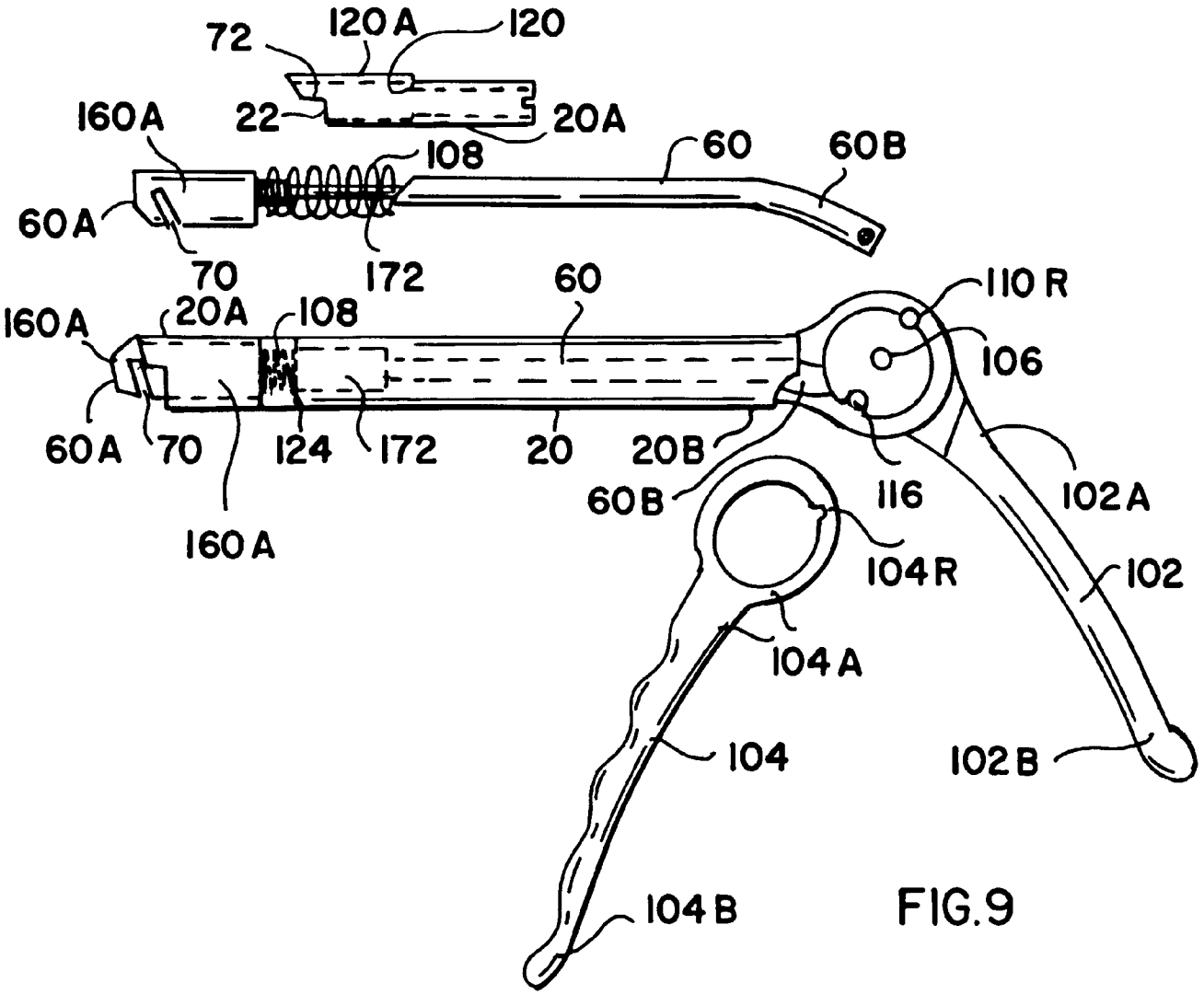
FIG. 9 is a broken away, close up view of the displacement mechanism of FIG. 8.

Referring to FIGS. 1-10, a line cutter 10 is disclosed for cutting virtually all types of line L, cleanly, and where necessary over a long reach without loss of mechanical advantage. The line cutter 10 includes a guide structure 20 preferably in the form of a guide tube 20 having a tube longitudinal axis TL and having a tube proximal end 20B and a tube distal end 20A with a tube distal edge, a segment of the tube distal edge being beveled to form a guide structure cutting edge 22 in the form of a tube cutting edge 22 along the guide tube 20 inner diameter and an opposing segment defining a tube distal end proximal recess 24 which is proximally recessed relative to the tube cutting edge 22. The line cutter 10 further includes a line engaging structure 60 slidable within the guide tube 20 for engaging a segment of line L, and includes a displacement mechanism 100 for displacing the line engaging structure 60 relative to the tube cutting edge 22 together with a segment of line L retained within the line engaging structure 60 into sheering contact with the tube cutting edge 22. The tube distal end proximal recess 24 permits a segment of line L retained within the line engaging structure 60 to move proximally past the tube cutting edge 22 so that the line L abuts the tube distal end 20A only at the tube cutting edge 22 during line L cutting. The guide tube 20, as well as the slide shaft 60, may have a cross-sectional shape which is round, square, rectangular, elliptical, triangular, or of virtually any other desired shape.

The line engaging structure 60 preferably is a slide shaft 60 having a shaft longitudinal axis SL and having a lateral line engaging passageway 70 for receiving a segment of line L generally perpendicular to the slide shaft longitudinal axis SL, the slide shaft 60 being retained within the guide tube 20 to be slidable along the slide shaft and guide tube longitudinal axes SL and TL, respectively, so that the line engaging passageway 70 and a segment of line L within the line engaging passageway 70 is slidable past and immediately adjacent to the tube cutting edge 22 with a clearance C of at most 0.015 inches to produce a sheering action with a clean cut and minimal wear to the tube cutting edge 22. Although 0.015 is the preferred maximum clearance C, the preferred or optimum clearance or tolerance between the line engaging passageway 70 and tube cutting edge 22 is 0.010 inches. The line engaging passageway 70 preferably is a line engaging notch 70 which is cut into the side of the shaft 60 and is angled distally, although a second version of the passageway 70 is a bore following either a diametric path or the path of a geometric cord through the slide shaft 60. Slide shaft 60 has a shaft proximal end 60A and has a shaft distal end 60B, and the line engaging passageway 70 preferably is located in the shaft distal end 60B. The tube cutting edge 22 at the tube distal end 20A, as noted above, preferably is a segment of the tube distal edge perpendicular to the tube longitudinal axis TL, and the tube distal edge forms a distally protruding step 72 adjacent to and at one end of the cutting edge 22 to better retain and position a segment of line L within the line engaging passageway 70. See FIGS. 1, 2 and 6. The remainder of the tube distal edge preferably is angled to correspond to the angle across the width of tube 20 of the line engaging notch 70. See FIG. 6. When the line engaging slot 70 advances a line segment L into contact with the cutting edge 22, the slot end and the distal side of the slot 70, together the cutting edge 22 form a triangle enclosing and compressing the line segment 22 from three directions simultaneously, to reduce or eliminate fraying of braided line segments L during cutting. See FIG. 7.

The shaft distal end 60B including the line retaining passageway 70 preferably is a separable distal shaft segment 160A removably mounted to the remainder of the slide shaft 60, which defines a proximal shaft segment 160. The distal shaft segment 160A preferably has a threaded axial mounting bore 162 in the distal shaft segment 160A proximal end, and the proximal shaft segment 160 has a correspondingly threaded axial and distally protruding mounting stud 164 sized and configured to screw into the mounting bore 162. See FIG. 4. Alternatively the threads in the mounting bore 162 and on the mounting stud 164 may be omitted and a wrist pin 166 fitted through registering diametric passageways 168 in the proximal and distal shaft segments 160 and 160A. See FIG. 5. The guide tube 20 and slide shaft 60 can be made virtually as long as may be needed for great reach for specific types of uses without noticeable loss of mechanical advantage.

The displacement mechanism 100 preferably includes a guide tube lever 102 connected fixedly to the guide tube proximal end 20B extending generally radially downwardly and proximally. See FIGS. 8-10. A wheel mounting panel 112 interconnects the guide tube proximal end 20B and the tube lever 102, and a pivot wheel 110 is rotatably connected to the wheel mounting panel 112 by a central wheel pin 106. The shaft proximal end 60A angles downwardly and pivotally connects to the pivot wheel 110 with a shaft pin 114 at a radial distance from the central wheel pin 106, so that rotating the pivot wheel 110 advances the slide shaft 60 within the guide tube 20 either distally or proximally depending on the direction of pivot wheel 110 rotation. A shaft lever 104 is also provided having a shaft lever mounting end 104A which preferably is annular to form a collar sized to fit snugly and engagingly around the circumference of the pivot wheel 110, and a lever set pin 116 fits into a circumferential wheel recess 110R in the pivot wheel 110 and also extends into a lever recess 104R in the inner circumference of the shaft lever annular mounting end 104A, rotationally locking the shaft lever annular mounting end 104A and the pivot wheel 110 together to be constrained to rotate in unison. Mechanical advantage increases exponentially as the shaft pin 114 rotationally moves with the pivot wheel 110 from a downward position relative to the central wheel pin 106 to a proximal position relative to the central wheel pin 106. As the shaft pin 114 advances around this arc, the shaft pin 114 proximal displacement decreases while upward or lateral displacement increases, so that the shaft distal end 60B and line engaging passageway 70 move more slowly but with greater force for every degree of shaft lever 104 rotation about the central wheel pin 106. See FIG. 10.

The removable distal shaft segment 160A preferably is connected to the proximal shaft segment 160 by screw threads, as described above, and the tube distal end 20A preferably is also separable from the remainder of the guide tube 20 to define a distal tube segment 120A fitted to a proximal tube segment 120. The distal tube segment 120A preferably includes the cutting edge 22 and the preferred edge step 72, and has a reduced diameter tube segment 122 which fits snugly or press fits into the distal tube segment 120A and forms an internal spring seating shoulder 124. The segment of the slide shaft 60 adjacent the threaded mounting stud 164 preferably is a reduced diameter shaft segment 172 and fits axially through a coil biasing spring 108 which bears against the distal end shaft segment 160A and against spring seating shoulder 124 within the distal tube segment 120A.

The guide tube 20 and the slide shaft 60, and particularly the guide tube and slide shaft distal ends 20B and 60B, respectively, preferably are formed of heat treated tool steel or other hard steel so that no deformation occurs when cutting line L of a hard material. The guide tube and the slide shaft distal ends preferably are formed of heat treated tool steel. The non-anodized areas of cutter 10, and particularly the tube cutting edge 22 and line engaging passageway 70, preferably are coated with BRY-PLEX™ manufactured by BRY-COAT CORPORATION to prevent corrosion.

It is alternatively contemplated that displacement mechanism 100 can be a ratchet mechanism.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A line cutter for cutting segments of line, comprising:

a guide structure in the form of a guide tube having a tube longitudinal axis and having a tube proximal end and a tube distal end with a tube distal edge, a segment of said tube distal edge being beveled to form a tube cutting edge and an opposing segment of which defining a tube distal edge proximal recess relative to said tube cutting edge;

a line engaging structure slidable within the guide tube cutting edge for engaging a segment of line;

and a displacement mechanism for displacing said line engaging structure relative to said tube cutting edge together with a segment of line retained by said line engaging structure into sheering contact with said tube cutting edge, said tube distal end proximal recess permitting a segment of line retained within said line engaging structure to move past said tube cutting edge such that the line abuts said tube distal edge only at said tube cutting edge during line cutting;

wherein said displacement mechanism comprises a slide shaft having a shaft proximal end; a guide tube lever connected fixedly to said tube proximal end extending generally radially downwardly; a wheel mounting panel interconnecting said tube proximal end and said guide tube lever; a pivot wheel rotatably connected to said wheel mounting panel by a central wheel pin, wherein said shaft proximal end angles downwardly and pivotally connects to said pivot wheel with a shaft pin at a radial distance from said'central wheel pin, such that rotating said pivot wheel advances said slide shaft within said guide tube; and a shaft lever having a shaft lever mounting end fixedly secured to said pivot wheel;

and wherein said shaft lever has a shaft lever mounting end which is annular to form a collar having an inner circumference and sized to fit snugly and engagingly around the circumference of said pivot wheel, and a lever set pin fits into a circumferential wheel recess in said pivot wheel and extends into a shaft recess in said inner circumference of said shaft lever annular mounting end, rotationally locking said shaft lever annular mounting end and said pivot wheel together to be constrained to rotate in unison.

2. The cutter of claim 1, wherein said guide tube has a tube cross-section which is one of round.

* * * * *